US010844875B2

(12) United States Patent
Zia et al.

(10) Patent No.: US 10,844,875 B2
(45) Date of Patent: Nov. 24, 2020

(54) SELF-COOLING ELECTRIC SUBMERSIBLE PUMP

(71) Applicant: GENERAL ELECTRIC COMPANY, Schenectady, NY (US)

(72) Inventors: Jalal Hunain Zia, Niskayuna, NY (US); Yogen Vishwas Utturkar, Niskayuna, NY (US); Nathaniel Benedict Hawes, Ballston Spa, NY (US)

(73) Assignee: GENERAL ELECTRIC COMPANY, Schenctedy, NY (US)

( * ) Notice: Subject to any disclaimer, the term of this patent is extended or adjusted under 35 U.S.C. 154(b) by 499 days.

(21) Appl. No.: 15/092,767

(22) Filed: Apr. 7, 2016

(65) Prior Publication Data

US 2017/0292533 A1 Oct. 12, 2017

(51) Int. Cl.
*F04D 29/58* (2006.01)
*E21B 43/12* (2006.01)
(Continued)

(52) U.S. Cl.
CPC ..... *F04D 29/5806* (2013.01); *E21B 36/001* (2013.01); *E21B 43/121* (2013.01);
(Continued)

(58) Field of Classification Search
CPC .. F04B 29/5806; F04B 29/58; F04B 29/5866; F04B 39/064; F04B 29/588; F04B 13/10;
(Continued)

(56) References Cited

U.S. PATENT DOCUMENTS 3,809,152 A * 5/1974 Boehmer ..... C09K 5/08 123/41.54
4,126,406 A 11/1978 Traylor et al.
(Continued)

FOREIGN PATENT DOCUMENTS

CA 2590566 C 7/2014
WO WO2015178887 A1 * 11/2015

OTHER PUBLICATIONS

Edwin Lister Lowel, "The Induced Decomposition of Diethyl Ether", The University of British Columbia, pp. 66, Apr. 1937.
(Continued)

*Primary Examiner* — Essama Omgba
*Assistant Examiner* — Christopher J Brunjes

(57) ABSTRACT

A self-cooling electric submersible pump having an integrated cooling system is provided. The cooling system is configured to cool and lubricate the electric motor section of the pump by expanding a compressed multi-component coolant fluid through flow channels within the motor. The coolant fluid contains a first fluid having a boiling point of at least 230° C. and a second fluid having a boiling point of less than 150° C. During pump operation the first fluid acts as a largely incompressible liquid and the second fluid behaves as a compressible gas. A compressor compresses the second fluid in the presence of the first fluid to produce a hot compressed coolant fluid from which heat is transferred to a production fluid being processed by the pump. The compressed coolant fluid is expanded through an orifice and into the motor flow channels, returning thereafter to the compressor.

17 Claims, 6 Drawing Sheets

(51) Int. Cl.
*F04D 13/10* (2006.01)
*F25B 1/04* (2006.01)
*E21B 36/00* (2006.01)

(52) U.S. Cl.
CPC ..... *E21B 43/128* (2013.01); *F04D 13/10* (2013.01); *F04D 29/586* (2013.01)

(58) Field of Classification Search
CPC ..... F25B 1/04; E21B 43/128; E21B 36/00; E21B 36/001; E21B 36/006; E21B 43/121; H02K 9/19; H02K 9/197; F04D 29/586; F04D 13/10
USPC ..... 310/87, 54, 59
See application file for complete search history.

(56) References Cited

U.S. PATENT DOCUMENTS 4,264,834 A * 4/1981 Armor ..... H02K 9/10 310/55
4,685,867 A 8/1987 Patun et al.
4,832,127 A 5/1989 Thomas et al.
5,349,499 A * 9/1994 Yamada ..... H01L 23/427 165/104.33
7,341,656 B1 * 3/2008 Malone ..... C10G 27/04 208/39
8,696,334 B2 4/2014 Hunt et al.
8,740,586 B2 6/2014 Martinez et al.
8,899,054 B2 12/2014 Jankowski et al.
2003/0110788 A1 * 6/2003 Koeneman ..... F28F 3/12 62/259.2
2005/0217859 A1 * 10/2005 Hartman ..... E21B 43/128 166/369
2009/0090486 A1 * 4/2009 Geskes ..... F28D 7/06 165/51
2009/0272129 A1 11/2009 Petty
2013/0091878 A1 4/2013 Jankowski et al.
2014/0094974 A1 * 4/2014 Rashid ..... G05D 7/0682 700/282
2014/0338918 A1 * 11/2014 Millheim ..... E21B 43/121 166/344
2015/0326074 A1 11/2015 Van Dam et al.

OTHER PUBLICATIONS

Wang et al.. "Lubricity-Enhancing Low-Temperature Diesel Fuel Additives", Journal of the American Oil Chemists' Society, vol. 89, Issue: 3, pp. 513-522, Mar. 2012.
Zhao L et al., "Thermal decomposition of 1-pentanol and its isomers: a theoretical study.", J Phys Chem A, 116(37):9238-44, Sep. 20, 2012.
Ban-Ki Moon, "Low GWP Working Fluid for High Temperature Heat Pumps:", Kontomaris-DuPont; European Heat Pump Summit, Nuremberg, Oct. 15, 2013.
International Search Report and Written Opinion issued in connection with corresponding PCT Application No. PCT/US2017/026291 dated Jun. 20, 2017.

* cited by examiner

SELF-COOLING ELECTRIC SUBMERSIBLE PUMP

BACKGROUND

The present invention relates to electric submersible pumps useful in a variety of fluid lifting applications. In particular, the present invention relates to self-cooling electric submersible pumps useful in hydrocarbon extraction.

A typical Electric Submersible Pump (ESP) system comprises surface electrical equipment, a long length of power cable (up to 10 kft) and an ESP pump motor which is integrally connected to a pump. The internal temperature of an ESP motor in operation may be forty degrees Celsius higher than its surroundings due to heat generated by electrical losses which invariably accompany energy transfer between a stator and its associated rotor. In hydrocarbon-producing wells, the high temperature of the downhole environment may limit the life and power density of the electric motor component of an electric submersible pump deployed within the well. In addition, high temperature may accelerate demagnetization of magnetic laminations in permanent magnet (PM) ESP motors. Such temperature sensitivity characteristics of electric motors limits the depth at which ESPs may be deployed. As electric submersible pumps are deployed at greater depths to tap deep subsurface hydrocarbon reservoirs, there is a need for electric submersible pumps having enhanced motor power density (power per unit length) and exhibiting robust performance at high temperature. The present invention addresses these and other challenges and provides novel, self-cooling electric submersible pumps.

BRIEF DESCRIPTION

In one embodiment, the present invention provides self-cooling electric submersible pump comprising: (a) a pump housing defining a pump inlet and a pump outlet; (b) a pumping section defining a production fluid flow path; (c) an electric motor section configured to drive the pumping section; and (d) a cooling system configured to cool the motor section, the cooling system comprising: (i) a coolant fluid comprising a first fluid having a boiling point of at least 230° C. and a second fluid having a boiling point of less than 150° C.; (ii) a compressor section configured to compress the coolant fluid and to produce thereby a hot compressed coolant fluid; (iii) a cooling section configured to cool the hot compressed coolant fluid by thermal contact with a production fluid being processed by the pump, and to produce thereby a cool compressed coolant fluid, the cooling section being integral to the pumping section and defining a portion of the production fluid flow path; and (iv) an orifice through which to expand the cool compressed coolant fluid into one or more coolant flow channels defined by the motor section.

In another embodiment, the present invention provides a self-cooling electric submersible pump comprising: (a) a pump housing defining a pump inlet and pump outlet; (b) a pumping section defining a production fluid flow path; (c) an electric motor section comprising a permanent magnet motor and configured to drive the pumping section; and (d) a cooling system configured to cool the motor section, the cooling system comprising: (i) a coolant fluid comprising a first fluid having a boiling point of at least 230° C. and a second fluid having a boiling point of less than 150° C., the second fluid being selected from the group consisting of hydrocarbons, aliphatic halocarbons, aliphatic alcohols, aliphatic esters, aliphatic acids and aliphatic ethers; (ii) a compressor section configured to compress the coolant fluid and to produce thereby a hot compressed coolant fluid; (iii) a cooling section configured to cool the hot compressed coolant fluid by thermal contact with a production fluid being processed by the pump, and to produce thereby a cool compressed coolant fluid, the cooling section being integral to the pumping section and defining a portion of the production fluid flow path; (iv) an orifice through which to expand the cool compressed coolant fluid into one or more coolant flow channels defined by the motor section, the motor section being in fluid communication with the compressor section; and (v) at least one hot compressed coolant fluid return conduit fluidly linking an outlet of the compressor section with the cooling section, at least a portion of the compressed hot coolant fluid return conduit being in direct contact with the production fluid.

In yet another embodiment, the present invention provides a method of producing a hydrocarbon production fluid comprising: (a) operating the self-cooling electric submersible pump to move a hydrocarbon-containing production fluid from the production zone to a surface receiving facility; wherein the self-cooling electric submersible pump comprises: (i) a pump housing defining a pump inlet and pump outlet; (ii) a pumping section defining a production fluid flow path; (iii) an electric motor section configured to drive the pumping section; and (iv) a cooling system configured to cool the motor section; wherein the cooling system comprises a coolant fluid comprising a first fluid having a boiling point of at least 230° C. and a second fluid having a boiling point of less than 150° C., a compressor section configured to compress the coolant fluid and to produce thereby a hot compressed coolant fluid, a cooling section configured to cool the hot compressed coolant fluid by thermal contact with a production fluid being processed by the pump, and to produce thereby a cool compressed coolant fluid, the cooling section being integral to the pumping section and defining a portion of the production fluid flow path; and an orifice through which to expand the cool compressed coolant fluid into one or more coolant flow channels defined by the motor section, the motor section being in fluid communication with the compressor section.

BRIEF DESCRIPTION OF THE DRAWING FIGURES

Various features, aspects, and advantages of the present invention will become better understood when the following detailed description is read with reference to the accompanying drawings in which like characters may represent like parts throughout the drawings. Unless otherwise indicated, the drawings provided herein are meant to illustrate key inventive features of the invention. These key inventive features are believed to be applicable in a wide variety of systems which comprising one or more embodiments of the invention. As such, the drawings are not meant to include all conventional features known by those of ordinary skill in the art to be required for the practice of the invention.

DETAILED DESCRIPTION

Figure 1:
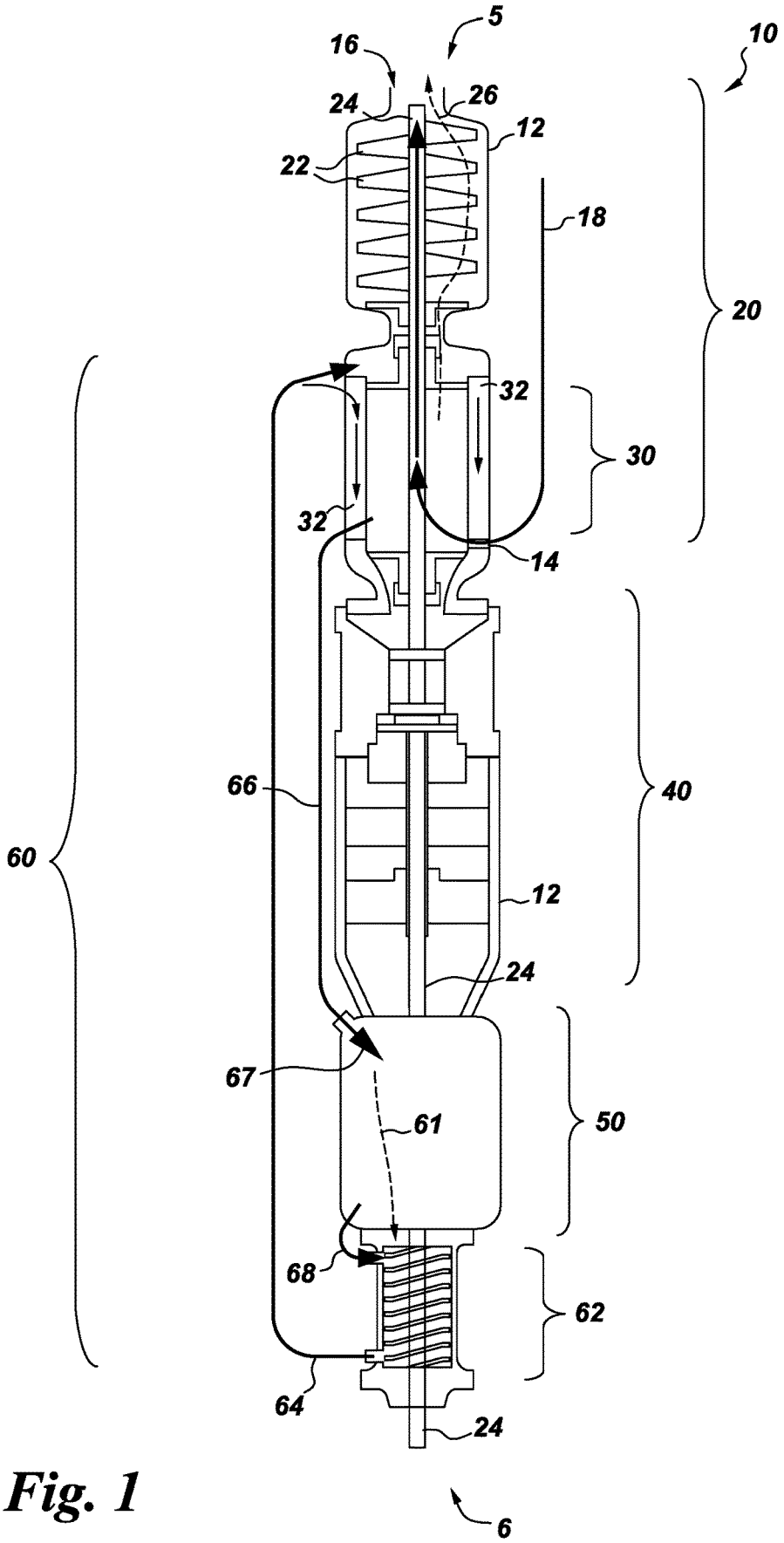
FIG. 1 illustrates an embodiment of a self-cooling electric submersible pump provided by the present invention.

As noted, in one or more embodiments, the present invention provides a self-cooling electric submersible pump and methods for its use in the efficient recovery of hydrocarbon fluids from hydrocarbon reservoirs located in the hot, high pressure environments characteristic of many deeper hydrocarbon wells today. In one or more embodiments, the self-cooling electric submersible pumps provided by the present invention are characterized an enhancement of the power density of the electric motor component of the pump. In one or more embodiments, power densities may be achieved which are 1.5-2.0 times greater than a corresponding electric submersible pump not equipped to be self-cooling.

The self-cooling electric submersible pump both cools and lubricates pump components using a multi-component coolant fluid comprising at least one higher boiling first fluid and at least one lower boiling second fluid. The higher boiling first fluid is selected such that it is thermally robust and remains substantially in the liquid phase during pump operation within a well bore. The lower boiling second fluid is selected such that it thermally robust and remains substantially in the gas phase during pump operation within a well bore. The lower boiling second fluid may be alternately compressed and expanded within a closed loop cooling system. The cooling system provides for transferring heat generated during second fluid compression to the well bore environment, and in particular to a moving production fluid being processed by the pump. The higher boiling first fluid is confined within same closed loop cooling system, is in direct contact with, and mixes with, the lower boiling second fluid. The higher boiling first fluid in the liquid state acts to lubricate moving pump components such as a compressor used to compress the second fluid. The first fluid and the second fluid may be substantially immiscible, fully miscible, or partially miscible. As will be appreciated by those of ordinary skill in the art, under pump operating conditions the two fluids will tend to remain segregated into a liquid phase comprising substantially all of the first fluid and a gas phase comprised mostly of the second fluid and comprising relatively little of the first fluid owing to the differences in the boiling points of the two fluids. In one or more embodiments, Henry's law will dictate how much of the second fluid will be contained within the liquid phase at any given temperature.

The higher boiling first fluid may be any suitable dielectric fluid which is stable and is substantially a liquid phase under typical operating conditions of the self-cooling electric submersible pump. Moreover, the higher boiling first fluid and its combination with the lower boiling second fluid must also be stable under typical operating conditions and comply with applicable health and safety guidelines. In one embodiment, the first fluid comprises a silicone oil such as SYLTHERM 800 Stabilized HTF (available from the DOW Chemical Company). In an alternate embodiment, the first fluid comprises an aromatic ether such as diphenyl ether (b.p. 257° C.). In yet another embodiment the first fluid comprises one or more synthetic motor oils such as Advance Ultra, 10W-40 motor oil available from Shell. In yet another embodiment, the first fluid comprises one or more semi-synthetic motor oils such as Advance AX7, 10W-40 likewise available from Shell.

In one or more embodiments, the first fluid is a dielectric oil having a boiling point greater than 230° C. at atmospheric pressure. In an alternate set of embodiments, the first fluid is a dielectric oil having a boiling point greater than 250° C. at atmospheric pressure. In yet an another alternate set of embodiments, the first fluid is a dielectric oil having a boiling point greater than 270° C. at atmospheric pressure.

The second fluid has a boiling point at atmospheric pressure of less than 150° C., and in one or more embodiments, comprises one or more aliphatic alcohols, aliphatic esters, aliphatic acids, aliphatic ethers, cycloaliphatic alcohols, cycloaliphatic esters, cycloaliphatic acids, cycloaliphatic ethers, aromatic alcohols, aromatic esters, aromatic acids, aromatic ethers, aliphatic hydrocarbons, cycloaliphatic hydrocarbons, aromatic hydrocarbons, aliphatic halocarbons, cycloaliphatic halocarbons, and aromatic halocarbons.

In one or more embodiments, the second fluid comprises at least one component selected from the group consisting of tetrafluoromethane; 1,2-dichlorotetrafluoroethane; 1,1-dichlorotetrafluoroethane; 1-chloro-1,1,2,2,-tetrafluormethane; 2-chloro-1,1,1,2-tetrafluorethane; pentafluorodimethyl ether; dichlorodifluoroethane; 1,1,1,2-tetrafluoroethane; bis (difluoromethyl)ether; 1,1,2-trifluoroethane; 1,1,1-trifluoroethane; 1,1-dichloro-2,2,3-trifluoropropane; 2-chloro-1,2,3,3-tetrafluoropropane; 1,1,1,3,3-pentafluoropropane; octafluoropropane; chloroheptafluorocyclobutane; octafluorocyclobutane; methyl trifluoromethyl ether; 2,2,2-trifluoroethyl methyl ether; methyl 1,1,2,2-tetrafluoroethyl ether; methane; ethane; propane; butane; isobutene; pentane; isopentane; cyclopentane; cyclohexane; tetrahydrofuran; heptane; isoheptane; octane; isooctane; dimethyl ether; diethyl ether; methanol; ethanol; isobutanol; methyl formate; ethyl formate; ethyl acetate; ethyl propionate; formic acid; acetic acid; toluene; xylene; thiophene; 2-methylthiophene; oxazole; pyrrolidine; N-methyl pyrrolidine; carbon dioxide; nitrogen; hydrogen; and sulfur hexafluoride.

Turning now to FIG. 1, the figure shows an embodiment of the present invention which is a self-cooling electric submersible pump 10 enclosed by pump housing 12 having a pump inlet 14 through which a production fluid 18 is drawn into the interior of pumping section 20 and a pump outlet 16 out through which the production fluid is driven by impellers 22. Impellers 22 are attached to drive shaft 24 which is turn driven by electric motor section 50. In one or more embodiments, impellers 22 work in concert with diffusers (not shown) to more efficiently move the production fluid through the pump. During operation production fluid 18 being processed by the self-cooling electric submersible pump flows through the pumping section 20 along production fluid flow path 26. Typically, the pump is configured vertically within a wellbore and has an upper end 5 and a lower end 6. Pump outlet 16 may be joined to production tubing 88 (See FIG. 6) through which the production fluid is transported to a surface facility. A drive shaft sealing section 40 inhibits ingress of production fluid 18 into motor section 50.

Still referring to FIG. 1, self-cooling electric submersible pump 10 comprises a cooling system 60 which is used to cool the motor section 50. The cooling system 60 comprises a coolant fluid 61 comprising a first fluid which during operation remains substantially in the liquid phase, and a second fluid which during operation remains substantially in the gas phase. During operation the coolant fluid 61 is introduced into compressor 62 wherein the second fluid component is compressed. Coolant fluid 61 exiting compressor 62 is a mixture of a largely uncompressed liquid phase first fluid and compressed second fluid. The mixture is hot, relative to the ambient, as a result of heat generated during compression of the second fluid component of the coolant fluid. The hot mixture passes through hot compressed coolant fluid conduit 64 and enters the cooling section 30 where it comes into thermal contact with moving process fluid 18. At least a portion of the heat of compression contained with the hot compressed coolant fluid is transferred into the lower temperature production fluid. In the embodiment shown, the hot compressed coolant fluid is introduced into one or more cooling channels 32 of the cooling section 30. The cooling channels are configured to allow heat transfer to the cooler production fluid, but not to permit direct contact and mixing of the coolant fluid with the production fluid.

Still referring to FIG. 1, the coolant fluid 61 exits the cooling section 30 as a mixture of compressed and uncompressed fluids at a lower temperature than the coolant fluid exiting the compressor 62. The coolant fluid exiting cooling section 30, at times herein referred to as the cool compressed coolant fluid, passes through coolant fluid conduit 66 linking cooling section 30 to motor section 50. As will be appreciated by those of ordinary skill in the art, in the embodiment shown the coolant fluid circulates within the cooling system 60 by the action of compressor 62.

Still referring to FIG. 1, cool compressed coolant fluid within coolant fluid conduit 66 enters the motor section 50 via orifice 67 across which there is a pressure differential created by the action of the compressor which reduces the pressure within the motor section relative to the pressure of the cool compressed coolant fluid within coolant fluid conduit 66. As the coolant fluid passes through the orifice, compressed components expand into the interior of the motor section and further cool as a result of this expansion. It is estimated that this cooling effect can significantly reduce the temperature of the motor section during operation, in one or more embodiments reducing the internal temperature of the motor section by 30 or more degrees centigrade relative to the temperature of the ambient. As the coolant fluid passes through the motor section heat generated by the operation of the motor is transferred to the coolant fluid which exits the motor upstream of the compressor and enters the compressor via coolant fluid conduit 68.

Still referring to FIG. 1, the coolant fluid exiting the motor section is a mixture of both condensed and gaseous components and is at times herein referred to as a the expanded coolant fluid. Both condensed and gaseous components pass through the compressor, the gaseous components being compressed by the compressor, the condensed components serving to lubricate various parts of the compressor requiring lubrication.

In the embodiment shown in FIG. 1, motor section 50 provides mechanical power to both the pumping section 20 and the compressor section 62. In an alternate set of embodiments, the pumping section 20 and compressor section 62 are driven by separate motor sections. In one or more embodiments, pumping section 20 and compressor section 62 share a common drive shaft 24. In an alternate set of embodiments, pumping section 20 and compressor section 62 are powered by the same motor section but rely on separate drive shafts. In one such embodiment, a first drive shaft driven by a first motor section drives a second drive shaft to which it is mechanically coupled by a planetary gear assembly.

Figure 2:
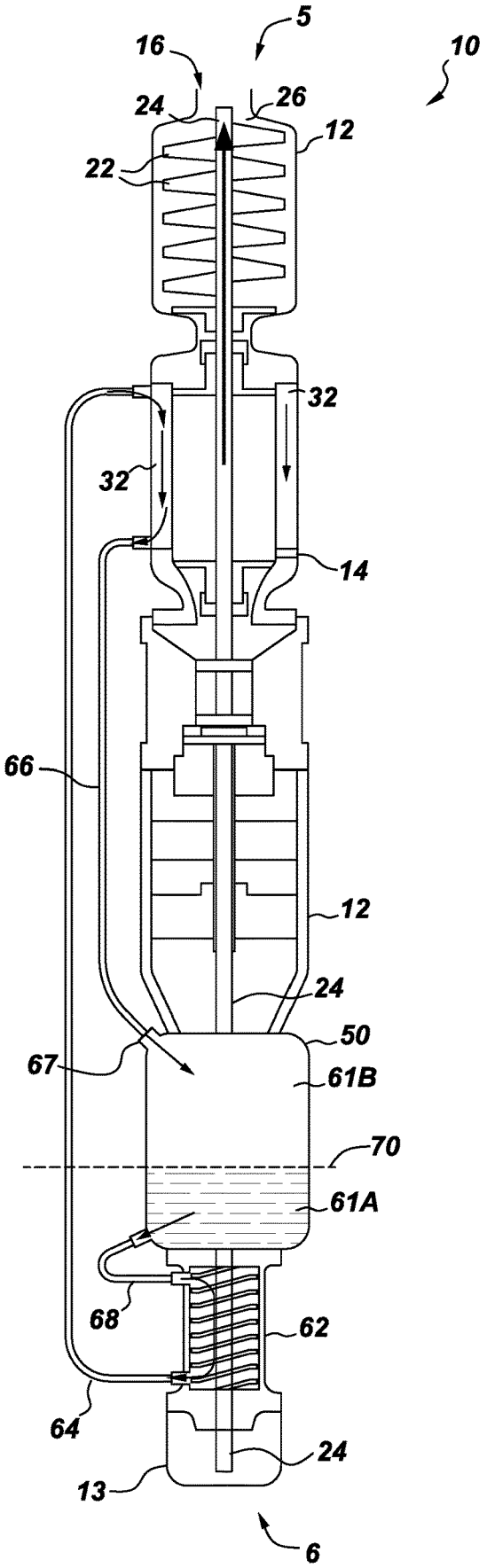
FIG. 2 illustrates an embodiment of a self-cooling electric submersible pump provided by the present invention.

Referring to FIG. 2, the figure represents the self-cooling electric submersible pump 10 featured in FIG. 1 but illustrating in an idealized format the pump prior to start up. Prior to start up, coolant fluid 61 is shown as separated into a liquid phase coolant fluid 61A and a gas phase coolant fluid 61B. As noted, in one or more embodiments, the liquid phase coolant fluid 61A contains substantially all of the first fluid, and the gas phase coolant is comprised mostly of the second fluid and comprises relatively little of the first fluid owing to the differences in the boiling points of the first fluid and the second fluid. The second fluid may in some embodiments be dissolved in liquid phase coolant fluid 61A to a greater or lesser extent according to the general principles of Henry's law. When configured vertically, liquid phase coolant fluid 61A will collect in the lowest fluidly linked interior volume of the self-cooling electric submersible pump as shown in FIG. 2. In the embodiment shown, line 70 represents the interface between the liquid and gas phases of the coolant fluid and is at times herein referred to as the liquid fill level line. In the embodiment shown, the unoccupied interior volume of motor section 50 below liquid fill level line 70, all of the unoccupied interior volume of compressor section 62 and that portion of compressed hot coolant fluid conduit 64 below line 70 are filled with liquid phase coolant fluid 61A. The remaining unoccupied interior volume of the cooling system is filled with gas phase coolant fluid 61B. Seals within drive shaft sealing section 40 inhibit loss of gas phase coolant fluid 61B to the environment via pumping section 20.

Still referring to FIG. 2, it is useful to consider in an exemplary embodiment how the coolant fluid might be introduced into the cooling system in order to gain a better understanding of the invention. Thus in one embodiment, a two-component coolant fluid 61 comprising a higher boiling first fluid and a lower boiling second fluid is introduced into the self-cooling electric submersible pump as follows. First, a predetermined volume of a lower boiling second fluid is introduced into the coolant system through a one way fluid inlet valve (not shown) traversing the pump housing in the motor section. As the lower boiling second fluid is being introduced, a pressure sensitive vent valve (not shown) allows an inert gas initially present within the unoccupied interior volume of the cooling system to be displaced by the lower boiling second fluid. In embodiments wherein the fluid inlet is located in the motor section 50 and the self-cooling electric submersible pump is to be filled with coolant fluid while configured vertically, the vent valve can be advantageously located anywhere on the cooling system above ultimate fill level 70, the level of liquid phase coolant fluid 61A within the cooling system of the self-cooling electric submersible pump upon completion of the coolant fluid filling operation. Alternatively, the cooling system may be filled advantageously in a non-vertical configuration, such as a horizontal configuration. Next, a predetermined volume of a higher boiling first fluid is introduced into the coolant system until the desired liquid level within the motor section prior to start up is reached. As will be appreciated by those of ordinary skill in the art, when the lower boiling second fluid is a pressurized gas which remains substantially in the gas phase following its initial introduction into the cooling system, the introduction of the higher boiling first fluid component in the liquid state may further compress the lower boiling second fluid. Additionally, a cracking pressure of one or more vent valves may advantageously regulate the pressure within the cooling system during the filling operation and thereafter. In one set of embodiments, the lower boiling second fluid is carbon dioxide and the higher boiling first fluid is a thermally stable silicone oil such as SYLTHERM 800 Stabilized HTF.

Figure 3:
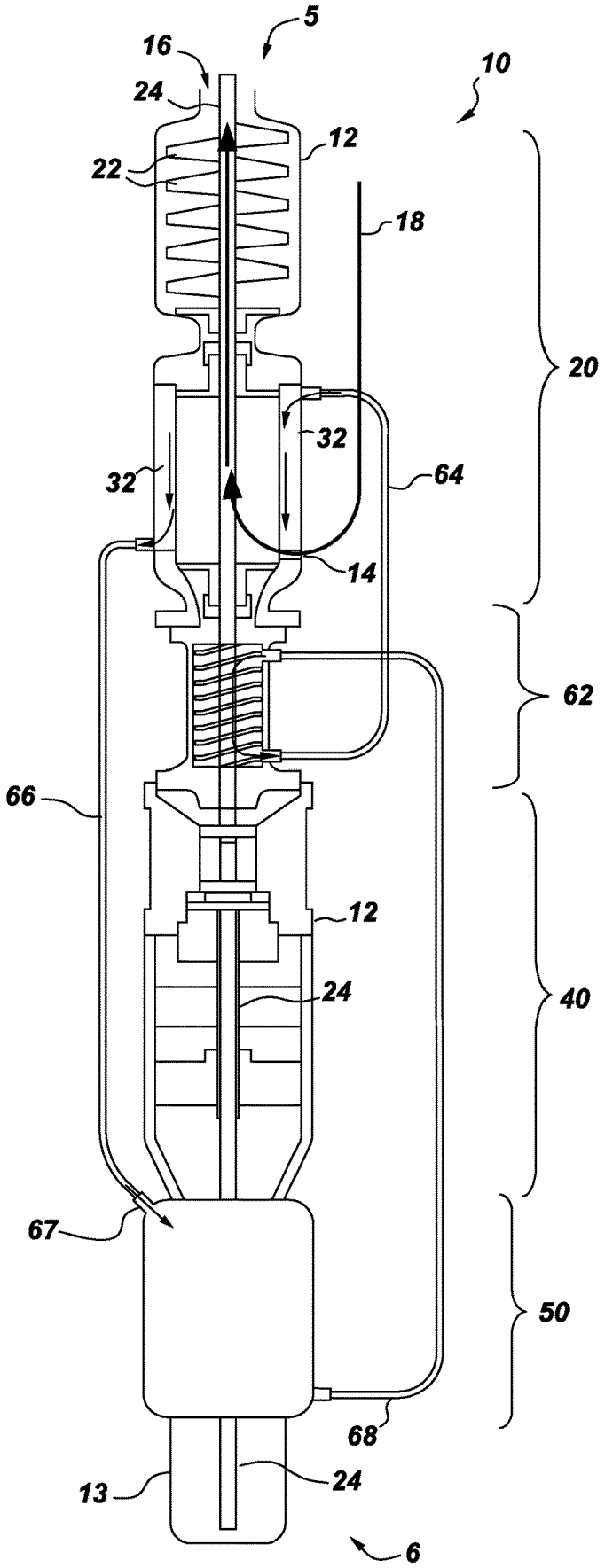
FIG. 3 illustrates an embodiment of a self-cooling electric submersible pump provided by the present invention.

Referring to FIG. 3, the figure represents a self-cooling electric submersible pump 10 provided by the present invention analogous to that featured in FIG. 1 but with the exception that the compressor section 62 is adjacent to the cooling section 30 (See FIG. 1) and is separated from motor section 50 by drive shaft sealing section 40. Whereas, in the embodiment shown in FIG. 1, the compressor section is adjacent to motor section 50. In addition, the self-cooling electric submersible pump shown in FIG. 3 features an end portion 13 of housing 12 which encloses the end portion of drive shaft 24 and obviates the need for a sophisticated shaft sealing section at end 6 of the pump to prevent ingress of well bore fluid into the cooling system when the compressor is not in operation, for example.

Figure 4:
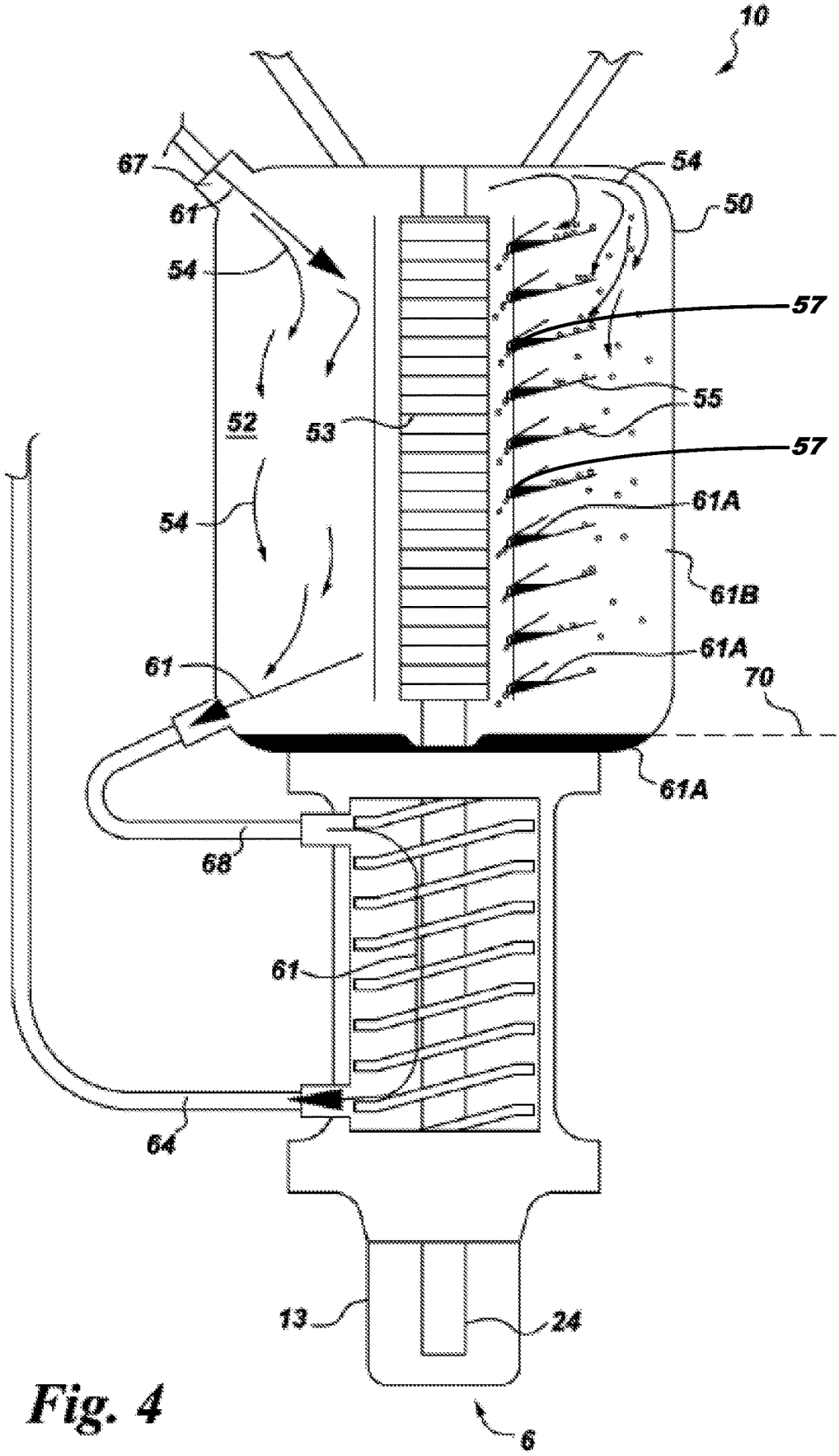
FIG. 4 illustrates components of one or more self-cooling electric submersible pumps provided by the present invention.

Referring to FIG. 4, the figure represents a detailed view of the motor section 50 and compressor section 62 of a self-cooling electric submersible pump 10 provided by the present invention under pump operating conditions. The motor section comprises a permanent magnet motor configured to drive a pumping section 20 (See FIG. 2) and having at least one rotor element comprising one or more permanent magnets. Coolant fluid 61 comprising a mixture of a liquid phase coolant fluid 61A and a compressed gas phase coolant fluid 61B is forced through orifice 67 into the unoccupied interior volume of electric motor section 50. As the compressed gas phase coolant fluid 61B expands it cools and in turn cools the electric motor and the liquid phase coolant fluid 61A. A portion of the liquid phase coolant fluid 61A is entrained by gas phase coolant fluid 61B into coolant fluid conduit 68 and passes into the compressor section 62 where the liquid phase coolant fluid 61A contacts and lubricates various compressor surfaces while the gas phase coolant fluid 61B is compressed by and heated by the compressor. Hot compressed gas phase coolant fluid 61B entrains at least a portion of the liquid phase coolant fluid 61A into compressed hot coolant fluid conduit 64 and is driven by the action of the compressor into the cooling section and back to orifice 67 to complete the refrigeration cycle.

Still referring to FIG. 4 and focusing on the electric motor section 50, the motor section comprises a permanent magnet electric motor comprising a stator 52 and a permanent magnet rotor 53 mechanically coupled to drive shaft 24. The coolant fluid 61 passes through the unoccupied interior volume of the stator motor along coolant flow channels 54 and encounters flow biasing elements 55 which capture droplets of the liquid phase coolant fluid 61A and bias the flow of liquid phase coolant fluid 61A toward stator bore orifices 57 and into the gap between the stator bore surface and the rotor. Liquid phase coolant fluid 61A within this gap comes into contact with and lubricates the stator bore surface, the rotor surface, and the drive shaft surface within the permanent magnet electric motor. In one or more embodiments, a sufficient portion of the liquid phase coolant fluid 61A collects within the lower portion of the electric motor to insure that only droplets of liquid phase coolant fluid 61A entrained by gas phase coolant fluid 61B are introduced into the compressor section thereby enhancing compressor performance since in any given cycle through the coolant system only a fraction of the liquid phase coolant fluid 61A passes through the compressor.

Figure 5:
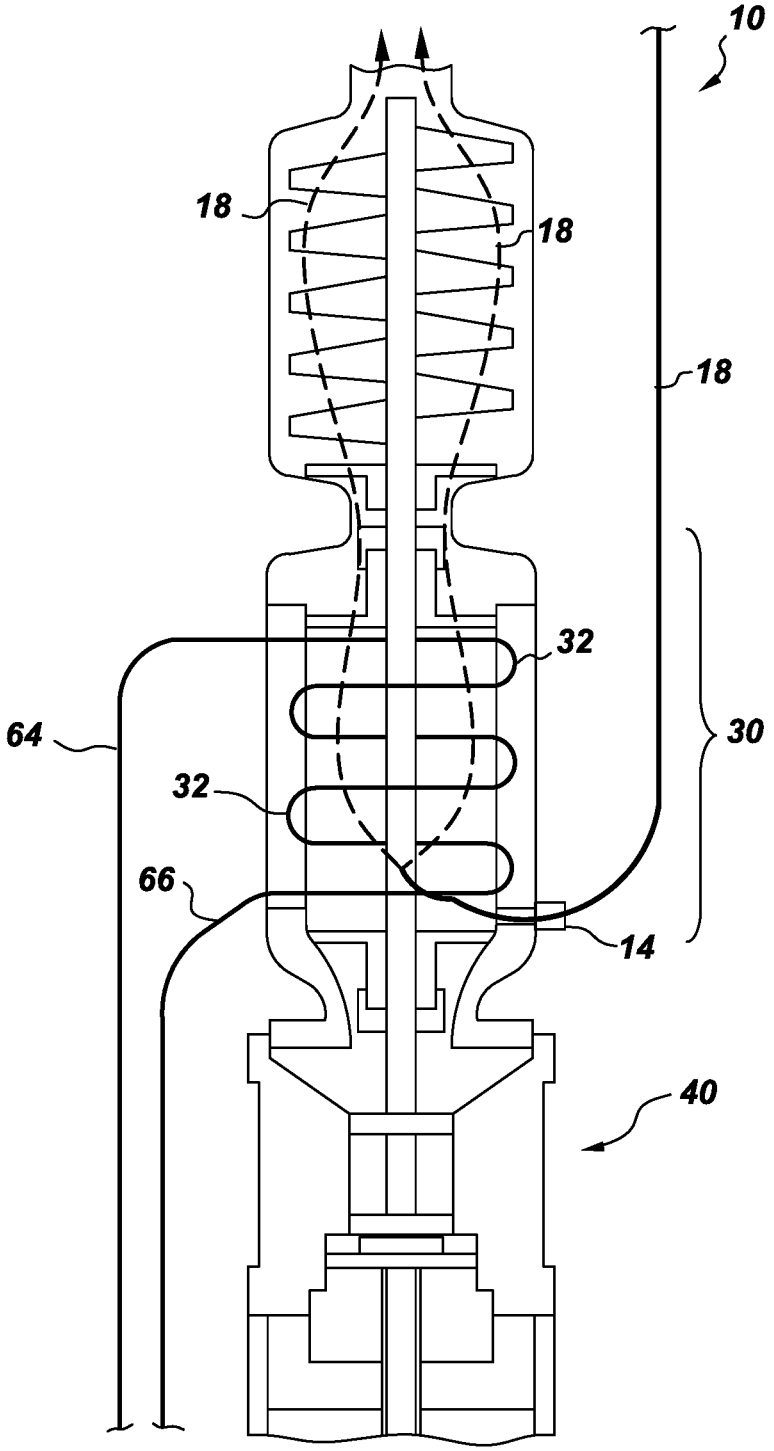
FIG. 5 illustrates components of one or more self-cooling electric submersible pumps provided by the present invention.

Referring to FIG. 5, the figure represents components of one or more self-cooling electric submersible pumps 10 provided by the present invention. In the embodiment shown coolant fluid flow channel 32 in the cooling section 30 is configured as a heat exchange tube coiled around the drive shaft 24. The hot compressed coolant fluid entering the cooling section is cooled by thermal contact with the moving production fluid 18 traversing the pumping section by the action of impellers 12. Cool compressed coolant fluid is channeled to orifice 67 and the motor section 50 through fluid conduit 66.

Figure 6:
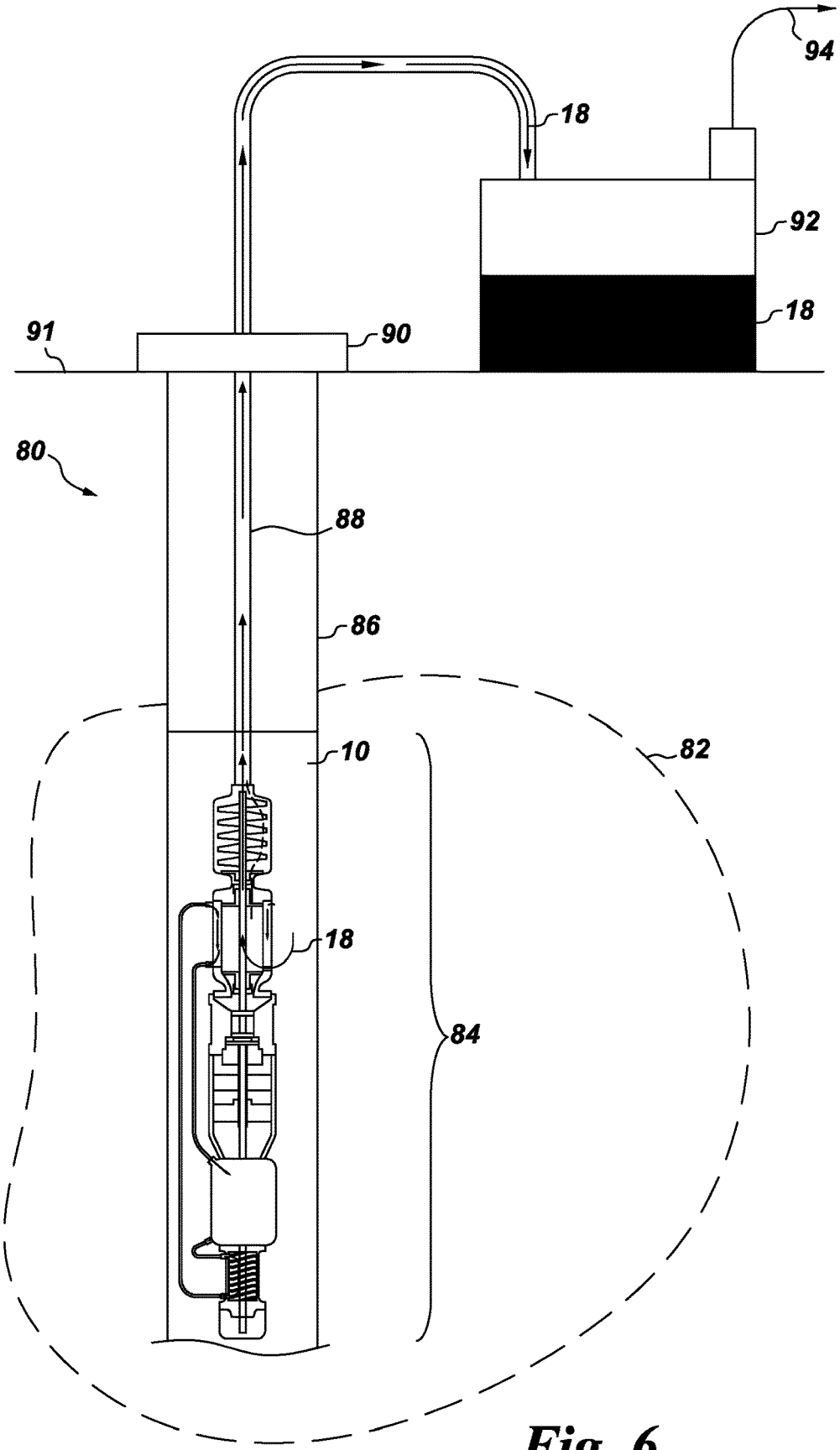
FIG. 6 illustrates components of one or more self-cooling electric submersible pumps provided by the present invention.

Referring to FIG. 6, the figure represents one or more applications for which the self-cooling electric submersible pump provided by the present invention may be especially suitable. In addition, the figure illustrates a method of producing a hydrocarbon production fluid.

Various applications in which the self-cooling electric submersible pumps provided by the present invention may be advantageously employed include lifting geothermal fluids, such as hot water, from geothermal reservoirs; high speed shipboard water evacuation; and hydrocarbon extraction from subterranean hydrocarbon reservoirs. This latter application is illustrated in FIG. 6 wherein a self-cooling electric submersible pump is depicted as disposed within a hydrocarbon-producing well 80 accessing a hydrocarbon reservoir 82. The self-cooling electric submersible pump is disposed within a production zone 84 of the well. Hydrocarbon fluids from the reservoir, at times herein collectively referred to as production fluid 18, enter the well from the reservoir via strategically located perforations in the well casing 86 and are lifted by the pump into production tubing 88 through which it is carried to wellhead 90 at the surface 91. Production fluid 18 may be piped from the wellhead to surface receiving facility 92 and optionally further processing steps 94 such as gas separation, for example.

Still referring to FIG. 6 and with reference to FIGS. 1-5, in one aspect the figure represents a method of producing a hydrocarbon production fluid 18 in which a self-cooling electric submersible pump is operated to move a hydrocarbon-containing production fluid from a subsurface production zone 84 of a hydrocarbon-producing well 80 to a surface receiving facility 92. The self-cooling electric submersible pump used according to one or more embodiments of the method comprises (i) a pump housing 12 defining a pump inlet 14 and pump outlet 16; (ii) a pumping section 20 defining a production fluid flow path 26; (iii) an electric motor section 50 configured to drive the pumping section; and (iv) a cooling system 60 configured to cool the motor section. The cooling system 60 comprises a coolant fluid 61 comprising a first fluid having a boiling point of at least 230° C. and a second fluid having a boiling point of less than 150° C. The cooling system 60 further comprises a compressor section 62 configured to compress the coolant fluid and to produce thereby a hot compressed coolant fluid. A cooling section 30 is configured to cool the hot compressed coolant fluid by thermal contact with the production fluid being processed by the pump, and to produce thereby a cool compressed coolant fluid. The cooling section is integrated within the pumping section and defines a portion of the production fluid flow path 26. The cool compressed coolant fluid is expanded through an orifice and into one or more coolant flow channels defined by the motor section, thereby cooling and lubricating the motor. In one embodiment, the method is used to lift a production fluid from a hydrocarbon-producing well located within a subsea hydrocarbon reservoir. In an alternate embodiment, the method is used to lift a production fluid from a hydrocarbon-producing well located within an on-shore hydrocarbon reservoir. In one embodiment, the method is used to produce a hydrocarbon-containing production fluid which is substantially free of liquid hydrocarbons, as in the case of a dry hydrocarbon gas well, for example. In an alternate embodiment, the method is used to produce a hydrocarbon-containing production fluid which is substantially composed of liquid hydrocarbons.

The foregoing examples are merely illustrative, serving to illustrate only some of the features of the invention. The appended claims are intended to claim the invention as broadly as it has been conceived and the examples herein presented are illustrative of selected embodiments from a manifold of all possible embodiments. Accordingly, it is Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of" Where necessary, ranges have been supplied, those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

In the specification and the claims of this disclosure, reference may be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

As used herein, the expression "remains substantially in the liquid phase" and equivalent expressions made in reference to the higher boiling first fluid component of coolant fluid 61, means that during operation of the self-cooling electric submersible pump provided by the present invention, more than fifty percent of the higher boiling first fluid is present in a liquid phase within the cooling system 60.

As used herein, the expression "remains substantially in the gas phase" and equivalent expressions made in reference to the lower boiling second fluid component of coolant fluid 61, means that during operation of the self-cooling electric submersible pump provided by the present invention, more than fifty percent of the lower boiling second fluid is present in a gas phase within the cooling system 60.

As used herein, the expression "substantially free of liquid hydrocarbons" made in reference to a production fluid 18 produced by the method of the present invention, means that the production fluid contains less than ten percent by weight hydrocarbon components which are liquids at twenty-five degrees centigrade at atmospheric pressure.

As used herein the term aliphatic refers to chemical species comprising one or more aliphatic radicals, as that term is defined herein, and not comprising either of an cycloaliphatic radical or an aromatic radical as those terms are defined herein. Similarly, as used herein the term cycloaliphatic refers to chemical species comprising one or more cycloaliphatic radicals, as that term is defined herein, and not comprising an aromatic radical as that term is defined herein. Likewise, as used herein the term aromatic refers to chemical species comprising one or more aromatic radicals, as that term is defined herein. Those of ordinary skill in the art will appreciate the hierarchy inherent in the foregoing definitions of the terms aliphatic, cycloaliphatic and aromatic.

As used herein the term "aliphatic radical" refers to an organic radical having a valence of at least one consisting of a linear or branched array of atoms which is not cyclic. Aliphatic radicals are defined to comprise at least one carbon atom. The array of atoms comprising the aliphatic radical may include heteroatoms such as nitrogen, sulfur, silicon, selenium and oxygen or may be composed exclusively of carbon and hydrogen. For convenience, the term "aliphatic radical" is defined herein to encompass, as part of the "linear or branched array of atoms which is not cyclic" a wide range of functional groups such as alkyl groups, alkenyl groups, alkynyl groups, haloalkyl groups, conjugated dienyl groups, alcohol groups, ether groups, aldehyde groups, ketone groups, carboxylic acid groups, acyl groups (for example carboxylic acid derivatives such as esters and amides), amine groups, nitro groups, and the like. For example, the 4-methylpent-1-yl radical is a $C_6$ aliphatic radical comprising a methyl group, the methyl group being a functional group which is an alkyl group. Similarly, the 4-nitrobut-1-yl group is a $C_4$ aliphatic radical comprising a nitro group, the nitro group being a functional group. An aliphatic radical may be a haloalkyl group which comprises one or more halogen atoms which may be the same or different. Halogen atoms include, for example; fluorine, chlorine, bromine, and iodine. Aliphatic radicals comprising one or more halogen atoms include the alkyl halides trifluoromethyl, bromodifluoromethyl, chlorodifluoromethyl, hexafluoroisopropylidene, chloromethyl, difluorovinylidene, trichloromethyl, bromodichloromethyl, bromoethyl, 2-bromotrimethylene (e.g., —$CH_2CHBrCH_2$—), and the like. Further examples of aliphatic radicals include allyl, aminocarbonyl (i.e., —$CONH_2$), carbonyl, 2,2-dicyanoisopropylidene (i.e., —$CH_2C(CN)_2CH_2$—), methyl (i.e., —$CH_3$), methylene (i.e., —$CH_2$—), ethyl, ethylene, formyl (i.e., —CHO), hexyl, hexamethylene, hydroxymethyl (i.e., —$CH_2OH$), mercaptomethyl (i.e., —$CH_2SH$), methylthio (i.e., —$SCH_3$), methylthiomethyl (i.e., —$CH_2SCH_3$), methoxy, methoxycarbonyl (i.e., $CH_3OCO$—), nitromethyl (i.e., —$CH_2NO_2$), thiocarbonyl, trimethylsilyl (i.e., $(CH_3)_3Si$—), t-butyldimethylsilyl, 3-trimethyoxysilylpropyl (i.e., $(CH_3O)_3SiCH_2CH_2CH_2$—), vinyl, vinylidene, and the like. By way of further example, a $C_1$-$C_{10}$ aliphatic radical contains at least one but no more than 10 carbon atoms. A methyl group (i.e., $CH_3$—) is an example of a $C_1$ aliphatic radical. A decyl group (i.e., $CH_3(CH_2)_9$—) is an example of a $C_{10}$ aliphatic radical.

As used herein the term "cycloaliphatic radical" refers to a radical having a valence of at least one, and comprising an array of atoms which is cyclic but which is not aromatic. As defined herein a "cycloaliphatic radical" does not contain an aromatic group. A "cycloaliphatic radical" may comprise one or more noncyclic components. For example, a cyclohexylmethyl group ($C_6H_{11}CH_2$—) is a cycloaliphatic radical which comprises a cyclohexyl ring (the array of atoms which is cyclic but which is not aromatic) and a methylene group (the noncyclic component). The cycloaliphatic radical may include heteroatoms such as nitrogen, sulfur, selenium, silicon and oxygen, or may be composed exclusively of carbon and hydrogen. For convenience, the term "cycloaliphatic radical" is defined herein to encompass a wide range of functional groups such as alkyl groups, alkenyl groups, alkynyl groups, haloalkyl groups, conjugated dienyl groups, alcohol groups, ether groups, aldehyde groups, ketone groups, carboxylic acid groups, acyl groups (for example carboxylic acid derivatives such as esters and amides), amine groups, nitro groups, and the like. For example, the 4-methylcyclopent-1-yl radical is a $C_6$ cycloaliphatic radical comprising a methyl group, the methyl group being a functional group which is an alkyl group. Similarly, the 2-nitrocyclobut-1-yl radical is a $C_4$ cycloaliphatic radical comprising a nitro group, the nitro group being a functional group. A cycloaliphatic radical may comprise one or more halogen atoms which may be the same or different. Halogen atoms include, for example; fluorine, chlorine, bromine, and iodine. Cycloaliphatic radicals comprising one or more halogen atoms include 2-trifluoromethylcyclohex-1-yl, 4-bromodifluoromethylcyclooct-1-yl, 2-chlorodifluoromethylcyclohex-1-yl, hexafluoroisopropylidene-2,2-bis (cyclohex-4-yl) (i.e., —$C_6H_{10}C(CF_3)_2$ $C_6H_{10}$—), 2-chloromethylcyclohex-1-yl, 3-difluoromethylenecyclohex-1-yl, 4-trichloromethylcyclohex-1-yloxy, 4-bromodichloromethylcyclohex-1-ylthio, 2-bromoethylcyclopent-1-yl, 2-bromopropylcyclohex-1-yloxy (e.g., $CH_3CHBrCH_2C_6H_{10}O$—), and the like. Further examples of cycloaliphatic radicals include 4-allyloxycyclohex-1-yl, 4-aminocyclohex-1-yl (i.e., $H_2NC_6H_{10}$—), 4-aminocarbonylcyclopent-1-yl (i.e., $NH_2COC_5H_8$—), 4-acetyloxycyclohex-1-yl, 2,2-dicyanoisopropylidenebis(cyclohex-4-yloxy) (i.e., —$OC_6H_{10}C(CN)_2C_6H_{10}O$—), 3-methylcyclohex-1-yl, methylenebis(cyclohex-4-yloxy) (i.e., —$OC_6H_{10}CH_2C_6H_{10}O$—), 1-ethylcyclobut-1-yl, cyclopropylethenyl, 3-formyl-2-terahydrofuranyl, 2-hexyl-5-tetrahydrofuranyl, hexamethylene-1,6-bis(cyclohex-4-yloxy) (i.e., —$OC_6H_{10}(CH_2)_6C_6H_{10}O$—), 4-hydroxymethylcyclohex-1-yl (i.e., 4-$HOCH_2C_6H_{10}$—), 4-mercaptomethylcyclohex-1-yl (i.e., 4-$HSCH_2C_6H_{10}$—), 4-methylthiocyclohex-1-yl (i.e., 4-$CH_3SC_6H_{10}$—), 4-methoxycyclohex-1-yl, 2-methoxycarbonylcyclohex-1-yloxy (2-$CH_3OCOC_6H_{10}O$—), 4-nitromethylcyclohex-1-yl (i.e., $NO_2CH_2C_6H_{10}$—), 3-trimethylsilylcyclohex-1-yl, 2-t-butyldimethylsilylcyclopent-1-yl, 4-trimethoxysilylethylcyclohex-1-yl (e.g., $(CH_3O)_3SiCH_2CH_2C_6H_{10}$—), 4-vinylcyclohexen-1-yl, vinylidenebis (cyclohexyl), and the like. The term "a $C_3$-$C_{10}$ cycloaliphatic radical" includes cycloaliphatic radicals containing at least three but no more than 10 carbon atoms. The cycloaliphatic radical 2-tetrahydrofuranyl ($C_4H_7O$—) represents a $C_4$ cycloaliphatic radical. The cyclohexylmethyl radical ($C_6H_{11}CH_2$—) represents a $C_7$ cycloaliphatic radical.

As used herein, the term "aromatic radical" refers to an array of atoms having a valence of at least one comprising at least one aromatic group. The array of atoms having a valence of at least one comprising at least one aromatic group may include heteroatoms such as nitrogen, sulfur, selenium, silicon and oxygen, or may be composed exclusively of carbon and hydrogen. As used herein, the term "aromatic radical" includes but is not limited to phenyl, pyridyl, furanyl, thienyl, naphthyl, phenylene, and biphenyl radicals. As noted, the aromatic radical contains at least one aromatic group. The aromatic group is invariably a cyclic structure having 4n+2 "delocalized" electrons where "n" is an integer equal to 1 or greater, as illustrated by phenyl groups (n=1), thienyl groups (n=1), furanyl groups (n=1), naphthyl groups (n=2), azulenyl groups (n=2), anthraceneyl groups (n=3) and the like. The aromatic radical may also include nonaromatic components. For example, a benzyl group is an aromatic radical which comprises a phenyl ring (the aromatic group) and a methylene group (the nonaromatic component). Similarly a tetrahydronaphthyl radical is an aromatic radical comprising an aromatic group ($C_6H_3$) fused to a nonaromatic component —$(CH_2)_4$—. For convenience, the term "aromatic radical" is defined herein to encompass a wide range of functional groups such as alkyl groups, alkenyl groups, alkynyl groups, haloalkyl groups, haloaromatic groups, conjugated dienyl groups, alcohol groups, ether groups, aldehyde groups, ketone groups, carboxylic acid groups, acyl groups (for example carboxylic acid derivatives such as esters and amides), amine groups, nitro groups, and the like. For example, the 4-methylphenyl radical is a $C_7$ aromatic radical comprising a methyl group, the methyl group being a functional group which is an alkyl group. Similarly, the 2-nitrophenyl group is a $C_6$ aromatic radical comprising a nitro group, the nitro group being a functional group. Aromatic radicals include halogenated aromatic radicals such as 4-trifluoromethylphenyl, hexafluoroisopropylidenebis(4-phen-1-yloxy) (i.e., —$OPhC(CF_3)_2$ PhO—), 4-chloromethylphen-1,3-trifluorovinyl-2-thienyl, 3-trichloromethylphen-1-yl (i.e., 3-$CCl_3Ph$-), 4-(3-bromoprop-1-yl)phen-1-yl (i.e., 4-$BrCH_2CH_2CH_2Ph$-), and the like. Further examples of aromatic radicals include 4-allyloxyphen-1-oxy, 4-aminophen-1-yl (i.e., 4-$H_2NPh$-), 3-aminocarbonylphen-1-yl (i.e., $NH_2COPh$-), 4-benzoylphen-1-yl, dicyanomethylidenebis(4-phen-1-yl oxy) (i.e., —$OPhC(CN)_2PhO$—), 3-methylphen-1-yl, methylenebis(4-phen-1-yl oxy) (i.e., —$OPhCH_2PhO$—), 2-ethylphen-1-yl, phenylethenyl, 3-formyl-2-thienyl, 2-hexyl-5-furanyl, hexamethylene-1,6-bis(4-phen-1-yloxy) (i.e., —$OPh(CH_2)_6$ PhO—), 4-hydroxymethylphen-1-yl (i.e., 4-$HOCH_2Ph$-), 4-mercaptomethylphen-1-yl (i.e., 4-$HSCH_2Ph$-), 4-methylthiophen-1-yl (i.e., 4-$CH_3SPh$-), 3-methoxyphen-1-yl, 2-methoxycarbonylphen-1-yloxy (e.g., methyl salicyl), 2-nitromethylphen-1-yl (i.e., 2-$NO_2CH_2Ph$), 3-trimethylsilylphen-1-yl, 4-t-butyldimethylsilylphenl-1-yl, 4-vinylphen-1-yl, vinylidenebis(phenyl), and the like. The term "a $C_3$-$C_{10}$ aromatic radical" includes aromatic radicals containing at least three but no more than 10 carbon atoms. The aromatic radical 1-imidazolyl ($C_3H_2N_2$—) represents a $C_3$ aromatic radical. The benzyl radical ($C_7H_7$—) represents a $C_7$ aromatic radical.

What is claimed is:

1. A self-cooling electric submersible pump comprising:

(a) a pump housing defining a pump inlet and pump outlet;

(b) a pumping section defining a production fluid flow path;

(c) an electric motor section configured to drive the pumping section, wherein the electric motor section comprises a permanent magnet motor, wherein the permanent magnet motor comprises:

at least one stator element;

at least one rotor element comprising one or more permanent magnets;

flow biasing elements;

stator bore orifices integral to the flow biasing elements, and wherein during operation, the flow biasing elements collect and direct a liquid phase coolant fluid to flow into the stator bore orifices, and the stator bore orifices direct the liquid phase coolant fluid to contact the at least one rotor element; and (d) a cooling system configured to cool the motor section, the cooling system comprising:

(i) a coolant fluid comprising a first fluid having a boiling point of at least 230° C. and a second fluid having a boiling point of less than 150° C.;

(ii) a compressor section configured to compress the coolant fluid and to produce thereby a hot compressed coolant fluid;

(iii) a cooling section configured to cool the hot compressed coolant fluid by thermal contact with a production fluid being processed by the pump, and to produce thereby a cool compressed coolant fluid, the cooling section being integral to the pumping section and defining a portion of the production fluid flow path;

(iv) an orifice through which to expand the cool compressed coolant fluid into one or more coolant flow channels defined by the motor section; and (v) a drive shaft sealing section configured to inhibit the ingress of the production fluid into the electric motor.

2. The self-cooling electric submersible pump according to claim 1, wherein the first fluid comprises one or more dielectric oils.

3. The self-cooling electric submersible pump according to claim 1, wherein the second fluid is selected from the group consisting of aliphatic alcohols, aliphatic esters, aliphatic acids, aliphatic ethers, and aliphatic halocarbons.

4. The self-cooling electric submersible pump according to claim 1, wherein the motor section provides mechanical power to both the pumping section and the compressor section.

5. The self-cooling electric submersible pump according to claim 1, wherein the compressor section is adjacent to the motor.

6. The self-cooling electric submersible pump according to claim 1, wherein the compressor section is adjacent to the cooling section.

7. The self-cooling electric submersible pump according to claim 1, wherein the cooling system comprises at least one hot compressed coolant fluid return conduit linking the compressor and the cooling section.

8. A self-cooling electric submersible pump comprising:

(a) a pump housing defining a pump inlet and pump outlet;

(b) a pumping section defining a production fluid flow path;

(c) an electric motor section configured to drive the pumping section, wherein the electric motor section has a permanent magnet motor that includes:

at least one stator element;

at least one rotor element comprising one or more permanent magnets;

flow biasing elements;

stator bore orifices integral to the flow biasing elements; and wherein during operation, the flow biasing elements collect and direct a liquid phase coolant fluid to flow into the stator bore orifices, and the stator bore orifices direct the liquid phase coolant fluid to contact the at least one rotor element; and (d) a cooling system configured to cool the motor section, the cooling system comprising:

(i) a coolant fluid comprising a first fluid having a boiling point of at least 230° C. and a second fluid having a boiling point of less than 150° C., the second fluid being selected from the group consisting of hydrocarbons, aliphatic halocarbons, aliphatic alcohols, aliphatic esters, aliphatic acids and aliphatic ethers;

(ii) a compressor section configured to compress the coolant fluid and to produce thereby a hot compressed coolant fluid;

(iii) a cooling section configured to cool the hot compressed coolant fluid by thermal contact with a production fluid being processed by the pump, and to produce thereby a cool compressed coolant fluid, the cooling section being integral to the pumping section and defining a portion of the production fluid flow path;

(iv) an orifice through which to expand the cool compressed coolant fluid into one or more coolant flow channels defined by the motor section, the motor section being in fluid communication with the compressor section;

(v) at least one hot compressed coolant fluid return conduit fluidly linking an outlet of the compressor section with the cooling section, at least a portion of the hot compressed coolant fluid return conduit being in direct contact with the production fluid; and (vi) a drive shaft sealing section configured to inhibit the ingress of the production fluid into the electric motor.

9. The self-cooling electric submersible pump according to claim 8, wherein the first fluid comprises one or more dielectric oils.

10. The self-cooling electric submersible pump according to claim 8, wherein the motor section provides mechanical power to both the pumping section and the compressor section.

11. The self-cooling electric submersible pump according to claim 8, wherein the compressor section is adjacent to the motor.

12. The self-cooling electric submersible pump according to claim 8, wherein the compressor section is adjacent to the cooling section.

13. A method of producing a hydrocarbon production fluid comprising:

(a) operating a self-cooling electric submersible pump to move a hydrocarbon-containing production fluid from a production zone of a hydrocarbon-producing well to a surface receiving facility;

wherein the self-cooling electric submersible pump comprises:

(i) a pump housing defining a pump inlet and pump outlet;

(ii) a pumping section defining a production fluid flow path;

(iii) an electric motor section configured to drive the pumping section comprising a permanent magnet motor, wherein the permanent magnet motor comprises:

at least one stator element;

at least one rotor element comprising one or more permanent magnets;

flow biasing elements;

stator bore orifices integral to the flow biasing elements; and wherein during operation, the flow biasing elements collect and direct a liquid phase coolant fluid to flow into the stator bore orifices, and the stator bore orifices direct the flow liquid phase coolant fluid to contact the at least one rotor element;

(iv) a cooling system configured to cool the motor section; and (v) a drive shaft sealing section configured to inhibit the ingress of the production fluid into the electric motor, wherein the cooling system comprises a coolant fluid comprising a first fluid having a boiling point of at least 230° C. and a second fluid having a boiling point of less than 150° C., a compressor section configured to compress the coolant fluid and to produce thereby a hot compressed coolant fluid, a cooling section configured to cool the hot compressed coolant fluid by thermal contact with the production fluid being processed by the pump, and to produce thereby a cool compressed coolant fluid, the cooling section being integral to the pumping section and defining a portion of the production fluid flow path; and an orifice through which to expand the cool compressed coolant fluid into one or more coolant flow channels defined by the motor section.

14. The method according to claim 13, wherein the hydrocarbon-producing well is located within a subsea hydrocarbon reservoir.

15. The method according to claim 13, wherein the hydrocarbon-producing well is located within an on-shore hydrocarbon reservoir.

16. The method according to claim 13, wherein the hydrocarbon-containing production fluid is substantially free of liquid hydrocarbons.

17. The method according to claim 13, wherein the hydrocarbon-containing production fluid comprises of liquid hydrocarbons.

* * * * *